US006449928B1

(12) United States Patent
Huson

(10) Patent No.: US 6,449,928 B1
(45) Date of Patent: Sep. 17, 2002

(54) SINGLE MOTOR DRIVE SYSTEM FOR THE ROTATING BOOM AND FILM CARRIAGE ASSEMBLY OF A STRETCH FILM WRAPPING SYSTEM FOR PALLETZIED LOADS

(75) Inventor: Gale W. Huson, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 106 days.

(21) Appl. No.: 09/723,154

(22) Filed: Nov. 27, 2000

(51) Int. Cl.[7] ..... B65B 53/00; B65B 13/04
(52) U.S. Cl. ..... 53/566; 53/588
(58) Field of Search ..... 53/556, 210, 588; 100/13, 14, 27, 28

(56) References Cited

U.S. PATENT DOCUMENTS

| | | | | | |
|---|---|---|---|---|---|
| 2,972,843 | A | * | 2/1961 | Du Broff | 53/588 |
| 4,905,448 | A | * | 3/1990 | Plitt | 53/588 |
| 4,938,008 | A | | 7/1990 | Salzsauler | |
| 5,107,657 | A | * | 4/1992 | Diehl et al. | 53/588 |
| 5,398,884 | A | | 3/1995 | Stanford | |
| 5,458,841 | A | | 10/1995 | Shirrell | |
| 5,765,344 | A | * | 6/1998 | Mandeville et al. | 53/556 |
| 5,779,179 | A | | 7/1998 | Zentmyer et al. | |
| 5,875,617 | A | * | 3/1999 | Scherer | 53/588 |
| 6,170,228 | B1 | * | 1/2001 | Zeman, III | 53/588 |
| 6,170,233 | B1 | * | 1/2001 | Marois et al. | 53/588 |
| 6,237,307 | B1 | * | 5/2001 | Zentmyer et al. | 53/588 |
| 6,267,356 | B1 | * | 7/2001 | Crawford | 191/12.2 R |

FOREIGN PATENT DOCUMENTS

| | | | | | |
|---|---|---|---|---|---|
| DE | 2810124 | A1 | * | 9/1978 | 53/210 |
| EP | 0032140 | A2 | * | 7/1981 | 53/210 |
| EP | 0070549 | A1 | * | 1/1983 | 53/588 |
| EP | 0279871 | A1 | * | 8/1988 | 53/588 |

OTHER PUBLICATIONS

Low Profile Stretchwrap Machine, Manual Spiral Wrapper, Operators Manual, Model G–200, Gerrard & Company, Apr., 1998.

* cited by examiner

*Primary Examiner*—Stephen F. Gerrity
(74) *Attorney, Agent, or Firm*—Donald J. Breh; Mark W. Croll; Lisa M. Soltis

(57) ABSTRACT

In a stretch film wrapping system for wrapping stretch film around a load disposed at a wrapping station, a single motor drive system is provided for controlling both the rotation of a rotational or orbiting boom member with respect to a static boom member and for controlling the elevation of a stretch film roll carriage assembly movably mounted upon a wrapping mast fixedly connected to the rotational or orbiting boom member.

28 Claims, 3 Drawing Sheets

SINGLE MOTOR DRIVE SYSTEM FOR THE ROTATING BOOM AND FILM CARRIAGE ASSEMBLY OF A STRETCH FILM WRAPPING SYSTEM FOR PALLETZIED LOADS

CROSS-REFERENCE TO RELATED PATENT APPLICATION

This patent application is related to a United States Patent Application which was filed on Nov. 2, 1999 in the name of Gale Huson, entitled APPARATUS AND METHOD FOR MANUALLY APPLYING STRETCH FILM TO PALLETIZED LOADS, and accorded Ser. No. 09/432,284.

FIELD OF THE INVENTION

The present invention relates generally to apparatus for applying or wrapping stretch film to or around palletized loads, products, or articles, and more particularly to a new and improved motor-powered stretch film load-wrapping apparatus for applying stretch film to palletized loads, articles or products, wherein a single motor drive system is incorporated within the apparatus so as to be able to be used for achieving or controlling both the rotational movement of the rotatable boom member, upon which the stretch film roll carriage assembly is mounted, relative to the static boom member, as well as the vertical movements of the stretch film roll carriage assembly relative to the rotatable boom member, so as to achieve various positional dispositions of the stretch film roll carriage assembly, relative to the rotatable boom member, attendant different operational modes of the stretch film roll carriage assembly in accordance with various segments or stages of a stretch film wrapping operation cycle.

BACKGROUND OF THE INVENTION

In the aforenoted patent application, it was noted that approximately fifty percent (50%) of all stretch film that is manufactured is applied to or wrapped around, for example, palletized loads or products by manual means. It was further noted that such stretch film has been conventionally applied to or wrapped around the palletized loads or products in accordance with either one of two well-known methods or techniques as implemented by the mechanisms or devices disclosed within U.S. Pat. 5,398,884 and 5,458,841 which issued respectively to Stanford on Mar. 21, 1995 and Shirrell on Oct. 17, 1995. It was noted still further that such conventional stretch film application or wrapping techniques, utilizing the disclosed mechanisms or implements, also encountered operational difficulties or drawbacks due, for example, to the fact that the film roll and dispensing mechanisms are quite heavy and cumbersome and yet they must be supported by the operator personnel. In addition, in order to fully or entirely wrap a particular load or product, the operator must either maintain the film roll and the dispensing mechanism at an elevated position so as to be able to wrap or encase upper region portions of the load or product, or alternatively, the operator must bend down while holding the film roll and its dispensing mechanism in order to wrap the film around the lower extremity portions of the palletized loads or products. Such procedures can obviously lead to discomfort, fatigue, and stress-related injuries. Accordingly, the system disclosed within the aforenoted patent application, wherein, for example, the film carriage assembly is movably supported upon a vertical mast by means of a counterweight or counterbalancing system, was developed in order to rectify the operational deficiencies of the aforenoted PRIOR ART manual film wrapping and dispensing systems disclosed within the aforenoted patents.

Obviously, a further alternative to the aforenoted PRIOR ART manually operated stretch film wrapping, dispensing, or application systems is to utilize powered or even fully automated stretch film wrapping, dispensing, or application systems. However, conventional powered or fully automated stretch film wrapping, dispensing, or application systems are known to be relatively complex, costly to manufacture, and require a relatively high degree of maintenance, and there are several reasons for these characteristics or factors. Firstly, in accordance with such conventionally known systems, separate motor drives must be provided for operating and controlling the movements of the rotatable boom member as well as the upward and downward elevational movements of the stretch film roll carriage assembly. Still further, in conjunction with such dual-motor drive systems, it is known that it is further required to incorporate within the control system suitable slip-ring or commutator structure so as to appropriately control the movements of the rotatable boom member and the vertically movable stretch film roll carriage assembly during different portions of the film wrapping operation cycle.

A need therefore exists in the art for a new and improved motor-powered stretch film load-wrapping apparatus for applying stretch film to palletized loads, products, or articles, wherein a single motor drive system is incorporated within the apparatus so as to be able to be used for achieving or controlling both the rotational movement of the rotatable boom member, upon which the stretch film roll carriage assembly is mounted, relative to the static boom member, as well as the vertical movements of the stretch film roll carriage assembly relative to the rotatable boom member, so as to achieve various positional dispositions of the stretch film roll carriage assembly, relative to the rotatable boom member, attendant different operational modes of the stretch film roll carriage assembly in accordance with various segments or stages of a stretch film wrapping operation cycle.

OBJECTS OF THE INVENTION

Accordingly, it is an object of the present invention to provide a new and improved motor-powered stretch film dispensing and application or wrapping apparatus for use in connection with the dispensing and wrapping or application of stretch film upon palletized loads, articles, packages, or products.

Another object of the present invention is to provide a new and improved motor-powered stretch film dispensing and application or wrapping apparatus, for use in connection with the dispensing and wrapping or application of stretch film upon palletized loads, articles, packages, or products, which effectively overcomes the various operational disadvantages or drawbacks characteristic of conventional stretch film dispensing and application or wrapping apparat An additional object of the present invention is to provide a new and improved motor-powered stretch film dispensing and application or wrapping apparatus, for use in connection with the dispensing and wrapping or application of stretch film upon palletized loads, articles, packages, or products, which effectively overcomes the various operational disadvantages or drawbacks characteristic of conventional stretch film dispensing and application or wrapping apparatus as a result of the incorporation therein of a motor-powered system for rotationally driving the rotatable boom member as well as for vertically elevating the stretch film roll carriage assembly.

A further object of the present invention is to provide a new and improved motor-powered stretch film dispensing and application or wrapping apparatus, for use in connection with the dispensing and wrapping or application of stretch film upon palletized loads, articles, packages, or products, which effectively overcomes the various operational disadvantages or drawbacks characteristic of conventional stretch film dispensing and application or wrapping apparatus as a result of the incorporation therein of a single motor drive system for both rotationally driving the rotatable boom member as well as for vertically elevating the stretch film roll carriage assembly.

SUMMARY OF THE INVENTION

The foregoing and other objectives are achieved in accordance with the teachings and principles of the present invention through the provision of new and improved motor-powered stretch film dispensing and application or wrapping apparatus which comprises a fixed upright or vertical mast member upon the upper end of which is fixedly mounted or supported a static boom member. A drive motor is fixedly mounted upon the static boom member, and a vertically disposed drive shaft is operatively engaged with a motor output shaft. The drive shaft passes downwardly through the static boom member and the lower end portion of the drive shaft is fixedly mounted within a rotatable boom member so as to cause rotation of the rotatable boom member when the drive motor is operated. A stretch film roll carriage assembly is movably upon a downright or vertically disposed wrapping mast upon the upper end of which the rotatable boom member is supported, and a cable drum is movably mounted upon the vertically disposed drive shaft. One end of a cable is fixedly secured to the cable drum while a second opposite end of the cable is fixedly secured to the stretch film roll carriage assembly. A cable drum lift spring mounted within the rotatable boom member acts upon an undersurface portion of the cable drum so as to bias the cable drum towards a first uppermost position with respect to the drive shaft such that the cable drum will be engaged with the static boom member and thereby be prevented from rotating. Accordingly, when the rotatable boom member is rotated, the cable is wound upon the cable drum thereby causing the stretch film roll carriage assembly to be raised.

First and second solenoid mechanisms are also fixedly mounted upon opposite lateral sides of the static boom member such that actuation rod members thereof can engage upper surface portions of the cable drum when the solenoid mechanisms are individually actuated. The actuation rod members of the solenoid mechanisms have different stroke lengths, and accordingly, when a first one of the solenoid mechanisms is actuated, the cable drum is moved downwardly a first predetermined amount with respect to the static boom member so as to be operatively disengaged from its locked position with respect to the static boom member and be interposed between the static and rotatable boom members. In this manner, the cable drum is permitted in effect to free-wheel or rotate freely with respect to the static and rotatable boom members whereby the stretch film roll carriage assembly is able to be moved downwardly along the downright or wrapping mast under the influence of gravity. Alternatively, when the second one of the solenoid mechanisms is actuated, the cable drum is moved downwardly a second predetermined amount with respect to the static boom member so as to be operatively disengaged from its locked position with respect to the static boom member and be lockingly engaged with the rotatable boom member. In this manner, the cable drum rotates along with the rotatable boom member such that the stretch film roll carriage assembly is maintained at a predetermined elevational position with respect to the palletized load, article, package, or product being wrapped whereby a predetermined portion of the stretch film being wrapped upon the palletized load, article, package, or product can be reinforced.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
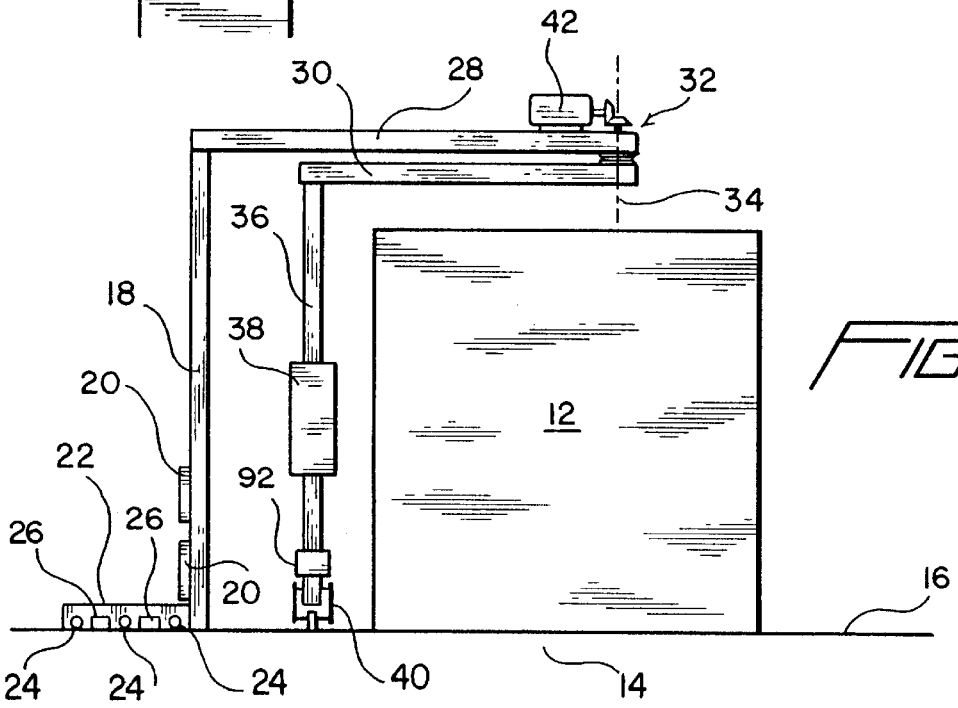
FIG. 1 is a schematic side elevational view of a new and improved motor-powered stretch film dispensing and application or wrapping apparatus having incorporated therein a single motor drive system for rotating the rotatable boom member and for vertically moving the stretch film roll carriage assembly of the stretch film wrapping apparatus which is used for wrapping a palletized load, package, product, or article with stretch film.

Referring now to the drawings, and more particularly to FIG. 1 thereof, a new and improved motor-powered stretch film dispensing and film application or wrapping apparatus or system, constructed in accordance with the principles and teachings of the present invention, is disclosed and is generally indicated by the reference character 10. A palletized load, package, product, or article, to be wrapped by means of the stretch film dispensed by the apparatus or system 10 of the present invention, is disclosed at 12 and is seen to be disposed, for example, at a wrapping station 14 which is defined upon a floor region 16 of a stretch film wrapping facility.

With respect to the new and improved motor-powered stretch film dispensing and film application or wrapping apparatus or system 10, constructed in accordance with the principles and teachings of the present invention, it is seen that the apparatus or system 10 comprises a vertically extending upright or mast member 18, and while the mast member 18 may fixed in position with respect to the wrapping station 14 in any one of several different ways, such as, for example, by being fixedly secured or bolted to a vertical wall or column, not shown, of the stretch film wrapping facility by suitable fastener and bracket assemblies 20, it is preferred that the lower end portion of the vertically extending mast member 18 be fixed or mounted upon a weighted base member 22 which is adapted to be movably disposed upon the floor region 16 of the stretch film wrapping facility. In this manner, the entire system or apparatus 10 is free-standing and yet is rendered substantially portable so as to be capable of being moved to other locations within the manufacturing or wrapping facility, or to be moved to another stretch film wrapping facility. In order to facilitate the portability of the apparatus or system 10, the base member 22 is preferably provided with spaced arrays of internal wheel members 24 which are adapted to engage and roll upon the floor region 16 of the stretch film wrapping facility. Alternatively, the base member 22 may be provided with a pair of spaced slots 26 for accommodating the tines of forklift apparatus for transporting the apparatus or system 10 between different wrapping stations 14.

A static boom member 28 has a first end portion thereof fixed upon the upper end portion of the vertically extending mast member 18, and a second opposite end portion of the static boom member 28 is adapted to have a first end portion of a rotational or orbiting boom member 30 rotatably mounted thereon through means of a single motor, rotary-drive and bearing system generally indicated by the reference character 32 such that the rotational or orbiting boom member 30 is rotated with respect to the static boom member 28 around a vertical axis 34. The second opposite end of the rotational or orbiting boom member 30 has a first upper end portion of a vertically extending downright or wrapping mast 36 dependently supported therefrom and mounted thereon, and a stretch film roll carriage assembly 38, having a stretch film roll, not shown, mounted thereon, is slidably mounted upon the vertically extending downright or wrapping mast 36 so as to be capable of movement between extreme upper and lower positions with respect to the vertically extending downright or wrapping mast 36. In this manner, the vertical movements of the stretch film roll carriage assembly 38 are capable of facilitating the wrapping of the stretch film around the palletized load, package, product, or article 12, disposed at the wrapping station 14, when the stretch film is dispensed from the stretch film roll mounted upon the stretch film roll carriage assembly 38 in accordance with different wrapping modes or techniques performed during a stretch film wrapping operation. It is noted that the stretch film roll carriage assembly 38 may be similar to the stretch film roll carriage assembly 46 as disclosed within the aforenoted related patent application. In addition, in order to support the downright member 36 and the rotational or orbiting boom member 30 during rotational movements of the rotational or orbiting boom member 30 and the downright member 36 around the wrapping station 14 in connection with stretch film wrapping operations being performed upon the palletized load, product, package, or article 12 disposed at the wrapping station 14, the second opposite lower end portion of the downright or wrapping mast 36 is provided with a support wheel mechanism or assembly 40 which is adapted to rollably engage the floor 16 of the manufacturing facility. It is noted that the support wheel mechanism or assembly 40 may be similar to the support wheel mechanism or assembly 42 disclosed within the aforenoted patent application.

With reference now being made to FIGS. 2*a*, 2*b*, 3, and 4, the new and improved single motor, rotary drive and bearing system, constructed in accordance with the teachings and principles of the present invention and generally indicated by the reference character 32, will now be described. It is to be noted that in accordance with the particular interactive operation of the various structural components of the single motor, rotary drive and bearing system 32, both rotational or orbital movements of the rotational or orbiting boom member 30, as well as coincident predetermined vertical movements of the stretch film roll carriage assembly 38, can be simply achieved or controlled by means of a single drive motor during various operational stages of a stretch film wrapping operation being performed upon a palletized load, product, package, or article disposed at the wrapping station 14 of the film wrapping or wrapped-load manufacturing facility.

More particularly, it is seen that the new and improved single motor, rotary drive and bearing system, constructed in accordance with the teachings and principles of the present invention and generally indicated by the reference character 32, comprises a single drive motor 42 which is fixedly mounted atop the static boom member 28 through means of a suitable fixture or pedestal 44 which is located at the distal end portion of the static boom member 28 so as to be disposed adjacent to or within the vicinity of the rotary axis 34 around which the rotational or orbiting boom member 30 rotates. The single drive motor 42 is provided with an output drive shaft 46, and the distal or free end portion of the output drive shaft 46 has a first bevel gear 48 integrally fixed thereon. An upstanding rotary driven shaft 50 has its lower end portion fixed within the proximal end portion of the rotational or orbiting boom member 30 and thereby defines the rotary axis 34 about which the rotational or orbiting boom member 30 rotates. The upper end portion of the rotary driven shaft 50 has a second bevel gear 52 fixed thereon, and the second bevel gear 52 is engaged or enmeshed with the first bevel gear 48 fixed upon the free end portion of the motor output drive shaft 46. Consequently, when drive motor 42 is actuated, output drive shaft 46 rotates thereby causing, in turn, rotation of the first bevel 48, second bevel gear 52, upstanding driven shaft 50, and rotational or orbiting boom member 30. Rotational or orbiting boom member 30 of course rotates with respect to the palletized load, package, article, or product 12 disposed at the wrapping station 14, and since the stretch film roll carriage assembly 38 is mounted upon the downright or wrapping mast 36 which is fixedly mounted upon the distal or free end portion of the rotational or orbiting boom member 30, the stretch film dispensed from the stretch film roll carriage assembly 38 is wrapped around the palletized load, product, package, or article 12 disposed at the wrapping station 14 during rotation of the rotational or orbiting boom member 30. It is to be noted that in order to permit the upstanding driven shaft 50 to freely rotate within and with respect to the static boom member 28, a first upper intermediate portion of the upstanding driven shaft 50 which passes through the static boom member 28 is disposed within a suitable bearing assembly 54 which is mounted within the static boom member 28.

In accordance with the primary unique feature characteristic of the present invention, and as has been noted or referred to hereinbefore, the single motor, rotary drive and bearing system 32, in addition to providing the rotational movement of the rotational or orbiting boom member 30, is also adapted to achieve and control the elevational movement and disposition of the stretch film roll carriage assembly 38 with respect to the downright or wrapping mast 36 and in conjunction with the rotational or orbiting movements of the rotational or orbiting boom member 30 such that different types of stretch film wrapping modes or techniques are able to be achieved as desired in connection with the wrapping or packaging of a particular palletized load, product, package, or article 12 disposed at the wrapping station 14. Accordingly, a cable drum assembly 55, comprising a cable drum or hub 56 and having an axially disposed bearing assembly 57 mounted thereon, is rotatably mounted upon a second lower intermediate portion of the upstanding driven shaft 50 so as to be axially interposed between the static boom member 28 and the rotational or orbiting boom member 30 and to be capable of rotational movement around the vertical axis 34. The cable drum or hub 56 is provided with upper and lower, vertically spaced flanged members 58,60, and it is seen that the upper and lower flanged members 58,60 are respectively provided with a plurality of upwardly and downwardly projecting detent pins 62, 63.

More particularly, the upper and lower flanged members 58, 60 are provided with a circumferentially or annularly extending array of eight (8) detent pins 62, 63 which are equiangularly spaced apart with respect to each other by means of an angular separation of forty-five degrees (45°). In a similar manner, the upper static boom member 28 is provided with an annular array of detent holes, apertures, or recesses 64, while the lower rotational or orbiting boom member 30 is likewise provided with an annular array of detent holes, apertures, or recesses 66. The cable drum or hub 56 has a first end portion of a cable 68 fixed thereon, and a second opposite end portion of the cable 68 is adapted to be fixed to the vertically movable stretch film roll carriage assembly 38 by means of a suitable bracket or the like 70, cable 68 being routed over a suitable pulley 71 rotatably mounted upon the distal or free end portion of the rotational or orbiting boom member 30. As can best be appreciated from FIGS. 2*a*, 3, and 4, the cable drum assembly 55 is adapted to be vertically disposed at different elevational positions with respect to the static boom member 28 and the rotational or orbiting boom member 30 whereby, in turn, different elevational positions of the stretch film roll carriage assembly 38 with respect to the rotational or orbiting boom member 30 may be achieved.

In order to achieve the different elevational positions of the cable drum assembly 55 with respect to the static boom member 28 and the rotational or orbiting boom member 30, it is seen that a lower end portion of a cable drum coil spring 72 is fixed within a recessed or socket portion 74 defined within the rotational or orbiting boom member 30, while an upper end portion of the cable drum coil spring 72 is disposed in frictional engagement with the undersurface of the lower flanged member 60 of the cable drum assembly 55. In this manner, the cable drum assembly 55 is normally biased to a first uppermost position by means of the cable drum coil spring 72 as shown in FIG. 2*a* whereby the plurality of upwardly projecting detent pins 62 will be disposed within the plurality of detent apertures or recesses 64. It is to be noted that if the angular or rotational disposition of the cable drum assembly 55 with respect to the static boom member 28 is such that, when the cable drum coil spring 72 normally biases the cable drum assembly 55 toward its uppermost position as shown in FIG. 2*a*, the upwardly projecting detent pins 62 are not properly angularly aligned with their respective apertures or recesses 64 defined within the static boom member 28, initial rotation of the rotational or orbiting boom member 30 will cause a corresponding rotation of the cable drum assembly 55, as a result of the frictional engagement defined between the cable drum coil spring 72 and the lower flanged member 60, whereby the upwardly projecting detent pins 62 will in effect snap into their respective recesses 64 defined within the static boom member 28 under the upwardly directed biasing force of the cable drum coil spring 72 whereby cable drum assembly 55 will in effect be rotationally locked upon the static boom member 28.

It can therefore be readily appreciated still further that once the upwardly projecting detent pins 62 are disposed within their respective recesses 64 defined within the static boom member 28 such that the cable drum assembly 55 is rotationally locked upon the static boom member 28, and the rotational or orbiting boom member 30 is rotated around axis 34 as a result of the rotational drive being transmitted to the rotational or orbiting boom member 30 by means of the drive motor 42, motor output shaft 46, bevel gears 48,52, and driven shaft 50, rotation of the rotational or orbiting boom member 30 around the axis 34 will cause the stretch film roll carriage assembly cable 68 to be wound around the drum portion 56 of the cable drum assembly 55. In this manner, as the rotational or orbiting boom member 30 is continuously rotated, the stretch film roll carriage assembly 38 will in effect be continuously pulled upwardly whereby stretch film from the stretch film roll mounted upon the stretch film roll carriage assembly 38 will be continuously dispensed and wrapped around the palletized load, package, product, or article 12 disposed at the wrapping station 14 in a vertically extending spiral-wrap array.

Figure 2B:
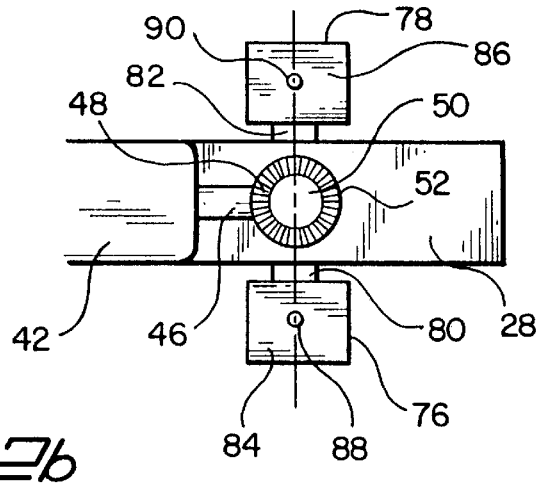
FIG. 2*b* is a partial top plan view of the single motor drive system illustrated in FIG. 2*a* showing the disposition of the two solenoid mechanisms upon opposite sides of the static boom member and the drive motor output shaft.
Figure 2A:
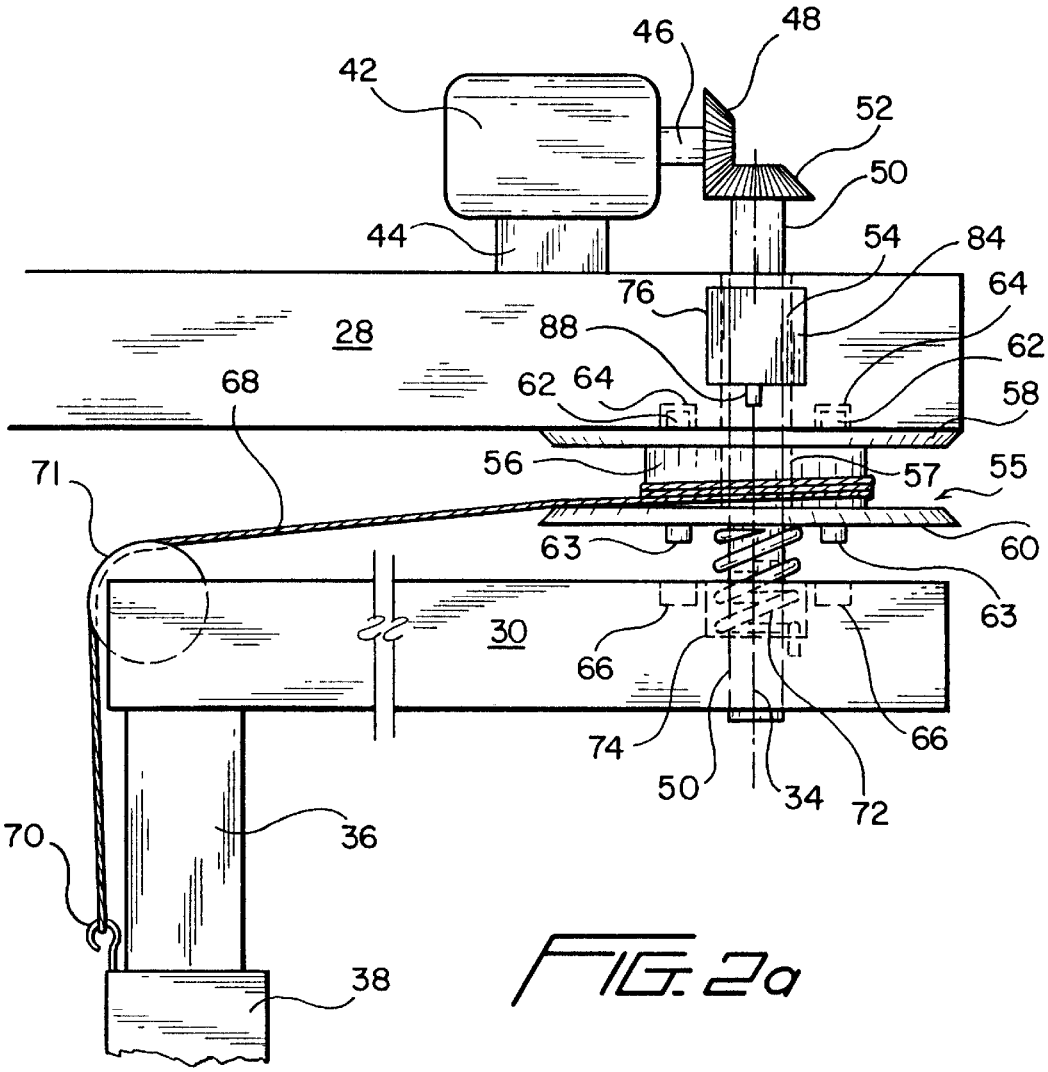
FIG. 2*a* is an enlarged and detailed side elevational view of the single motor drive system developed in accordance with the principles and teachings of the present invention and used in conjunction with the powered apparatus of FIG. 1 for operating an d controlling the rotational movement of the rotatable boom and the vertical elevational movement of the stretch film roll carriage assembly wherein the cable drum, operatively associated with the stretch film roll carriage assembly, is illustrated at an uppermost position at which the cable drum is rotationally locked to the static boom such that rotation of the rotatable boom causes vertically upward movement of the stretch film roll carriage assembly in conjunction with rotation of the rotatable boom whereby the stretch film is continuously wrapped around the article to be wrapped at different elevational positions or levels.

With reference continuing to be made to FIGS. 2*a*, 2*b*, 3, and 4, and as may best be appreciated from FIG. 2*b*, a pair of solenoid devices 76, 78 are fixedly mounted upon respective opposite sides of the static boom member 28 by means of suitable mounting brackets 80, 82. As is well known, each one of the solenoid devices 76, 78 comprises a body portion 84,86 and a plunger mechanism 88, 90, and the solenoid devices 76, 78 are constructed in such a manner that the actuated stroke of the respective plunger mechanisms 88, 90 of the two solenoid devices 76, 78 are different, that is, for example, the stroke of the plunger mechanism 90 of the solenoid device 78 is longer than the stroke of the plunger mechanism 88 of solenoid device 76. In addition, the lower end portion of each plunger mechanism 88, 90 of the solenoid devices 76, 78 is adapted to operatively engage a diametrically opposite upper surface portion of the upper flanged member 58 of the cable drum assembly 55 when in fact a particular one of the solenoid devices 76, 78 is actuated. As can therefore be appreciated from a comparison between FIGS. 2*a*,3, and 4, when neither one of the solenoid devices 76, 78 is actuated, the plunger mechanisms 88, 90 of the solenoid devices 76, 78 are disengaged from the upper surface portion of the upper flanged member 58 of the cable drum assembly 55 and the coil spring 72, fixedly mounted upon the rotational or orbiting boom member 30 and engaged with the undersurface of the lower flanged member 60 of the cable drum assembly 55, will cause the cable drum assembly 55 to be moved to its uppermost vertical position such that the detent pins 62 of the upper flanged member 58 of the cable drum assembly 55 will be disposed within the recesses 64 formed within the lower surface portion of the static boom member 28 whereupon the cable drum assembly 55 is effectively rotationally locked to the static boom member 28 as has been discussed hereinbefore. Accordingly, again, as has also been discussed hereinbefore, as the rotational or orbiting boom member 30 is continuously rotated, the stretch film roll carriage assembly 38 will in effect be continuously pulled upwardly whereby stretch film from the stretch film roll mounted upon the stretch film roll carriage assembly 38 will be continuously dispensed and wrapped around the palletized load, package, product, or article 12 disposed at the wrapping station 14 in a vertically extending spiralwrap array.

Figure 3:
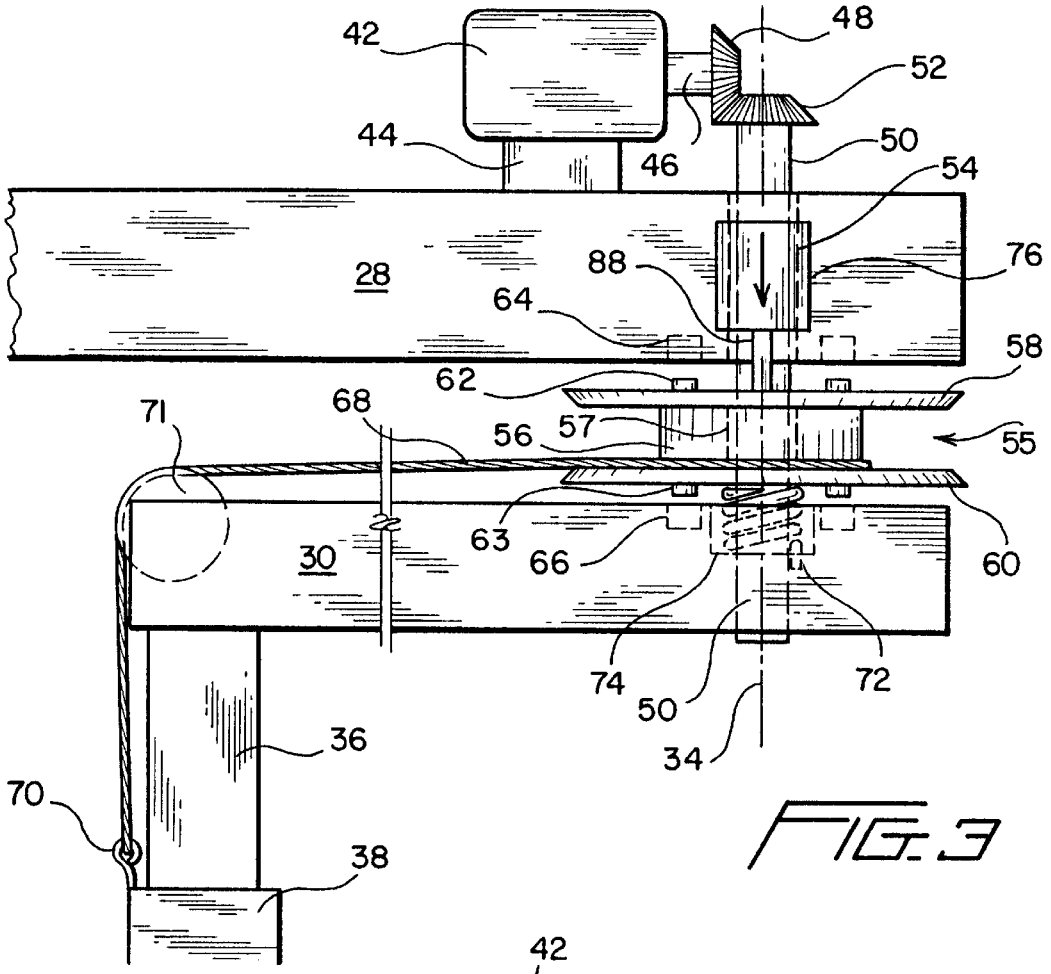
FIG. 3 is an enlarged and detailed side elevational view similar to that of FIG. 2 showing, however, the cable drum, operatively associated with the stretch film roll carriage assembly, disposed at an intermediate position at which the cable drum is disposed in a rotationally free state with respect to the rotatable and static booms such that the cable drum can in effect free-wheel or freely rotate whereby the stretch film roll carriage assembly can be vertically lowered to the bottom of the vertical mast under its own weight, or in other words, under the influence of gravity, upon completion of a stretch film wrapping operation cycle and in preparation for the commencement of a subsequent stretch film wrapping operation cycle.

On the other hand, as a first alternative mode of operation, when the first solenoid device 76 is actuated, its plunger mechanism 88 is accordingly actuated so as to be extended throughout its operative stroke whereupon the plunger mechanism 88 now operatively engages the upper surface portion of the upper flanged member 58 of the cable drum assembly 55. In this manner, the actuated solenoid device 76 and its plunger mechanism 88 causes the cable drum assembly 55 to be moved downwardly, against the biasing force of the coil spring 72, from its uppermost position shown in FIG. 2*a*, at which the cable drum assembly 55 is rotationally locked upon the static boom member 28, to an intermediate position as shown in FIG. 3 at which both sets of detent pins 62, 63 are disposed in disengaged states with respect to their respective detent holes, apertures, or recesses 64, 66 provided within the static boom member 28 and the rotational or orbiting boom member 30 whereby, in turn, the cable drum assembly 55 is effectively disengaged from both the static boom member 28 and the rotational or orbiting boom member 30. As a result of such intermediate disposition of the cable drum assembly 55 with respect to the static boom member 28 and the rotational or orbiting boom member 30, the cable drum assembly 55 is in effect permitted to free-wheel or freely rotate with respect to the static boom member 28 and rotational or orbiting boom member 30 whereby cable 68 is unwound from the cable drum 56 and the stretch film roll carriage assembly 38 is vertically lowered upon wrapping mast 36. The weight of the stretch film roll carriage assembly 38 is such as to easily overcome any frictional drag forces developed between the upper end of the coil spring 72 and the undersurface portion of the lower flanged member 60 of the cable drum assembly 55.

This free-wheeling mode of operation is referred to as a resetting operation and is implemented upon the conclusion of a particular stretch film wrapping operation with respect to a particular palletized load, package, product, or article 12 disposed at the wrapping station 14 in preparation for the implementation of a successive or subsequent wrapping operation to be performed upon a subsequent or successive palletized load, product, package, or article to be disposed at the wrapping station 14. The stretch film roll carriage assembly 38 will be lowered to its lowermost position upon the wrapping mast 36 in preparation for the implementation of a successive or subsequent wrapping operation to be performed upon a subsequent or successive palletized load, product, package, or article to be disposed at the wrapping station 14, and in order to cushion, arrest, or counteract the weight of the falling or lowered stretch film roll carriage assembly 38 as the same moves downwardly along the wrapping mast 36, a suitable pneumatic or hydraulic shock absorber 92 is mounted upon the lower end portion of the wrapping mast 36. Obviously, when such a successive or subsequent wrapping operation is to be initiated or commenced, the solenoid device 76 is deactuated, the plunger mechanism 88 is accordingly retracted, and the coil spring 72 will again act upon the cable drum assembly,55 so as to elevate or bias the same to its uppermost position at which the cable drum assembly 55 will again be rotationally locked upon the static boom member 28, through means of the detents pins 62 and detent recesses 64. In this manner, as has been noted hereinfore, continuous rotation of the rotational or orbiting boom member 30 around axis 34 will cause cable 68 to be continuously wound upon the cable drum 56 so as to continuously elevate or raise the stretch film roll carriage assembly 38 whereby the stretch film is wrapped around the new palletized load, product, package, or article 12 disposed at the wrapping station 14 in a spiral wrap mode.

Figure 4:
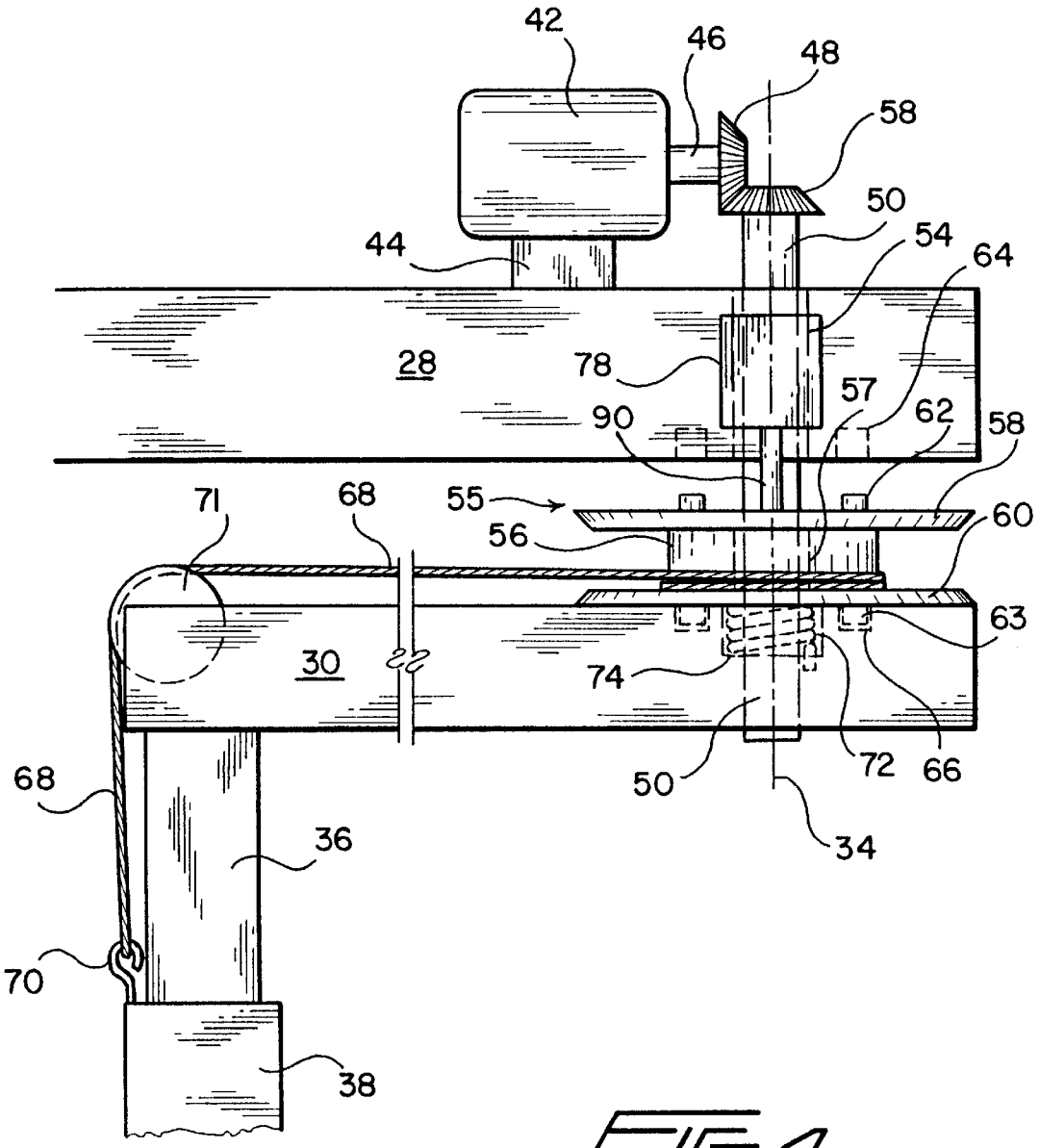
FIG. 4 is an enlarged and detailed side elevational view similar to that of FIGS. 2*a* and 3 showing, however, the cable drum, operatively associated with the stretch film roll carriage assembly, disposed at a lowermost position at which the cable drum is rotationally locked to the rotatable boom such that rotation of the rotatable boom causes the stretch film roll carriage assembly to be maintained at a predetermined elevational position or level with respect to the rotational boom and its vertical wrapping mast whereby the stretch film is continuously wrapped around the article being wrapped at the same elevational position or level so as to reinforce the wrapped stretch film at a particular elevational position or level upon the wrapped palletized load, article, product, or package.

As a second alternative mode of operation, when the second solenoid device 78 is actuated such that the plunger mechanism 90 thereof is actuated to its extended position, the lower end portion of the plunger mechanism 90 engages and acts upon the upper flanged member 58 of the cable drum assembly 55 and causes the cable drum assembly 55 to be moved downwardly, against the biasing force of coil spring 72, from its uppermost raised position shown in FIG. 2*a*, at which the cable drum assembly 55 is rotationally locked to the static boom member 28, to the lowermost position as shown in FIG. 4 at which the cable drum assembly 55 is in effect rotationally locked upon the rotational or orbiting boom member 30. In this manner or state, the cable drum assembly 55 will rotate along with the rotational or orbiting boom member 30, and not relative to the rotational or orbiting boom member 30 as was the case illustrated in FIG. 2*a* when the cable drum assembly 55 was rotationally locked upon the static boom member 28, and consequently, cable 68 will not be wound further upon the cable drum 56. Accordingly, the elevational disposition of the stretch film roll carriage assembly 38 with respect to the rotational or orbiting boom member 30 will remain fixed, and therefore, as the rotational or orbiting boom member 30 continues to rotate around axis 34, stretch film dispensed from the stretch film roll disposed upon the stretch film roll carriage assembly 38 will continue to be wrapped around the palletized load, package, product, or article 12 disposed at the wrapping station 14 at a predetermined elevational level.

This mode of operation is referred to as a reinforcing mode because, in effect, reinforcing stretch film is being continuously wrapped around the palletized load, product, package, or article at a particular elevational level. This mode of operation is implemented when, after stretch film has been wrapped around predetermined portions or regions of the palletized load, product, package, or product 12 disposed at the wrapping station 14, it is desired to add additional stretch film to a predetermined region or portion of the palletized load, package, product, or article 12 which has already been wrapped with or encased within the stretch film. In connection with the rotational or angular locking together of the cable drum assembly 55 with the rotational or orbiting boom member 30 during the reinforcing mode of operation as illustrated within FIG. 4, and similar to the case when the cable drum assembly 55 was to be rotationally locked upon the static boom member 28 under the upward biasing force of the coil spring 72 when both of the solenoid devices 76, 78 were not actuated as illustrated in FIG. 2*a*, if the angular or rotational disposition of the cable drum assembly 55 with respect to the rotational or orbiting boom member 30 is such that, when the solenoid device 78 biases the cable drum assembly 55 downwardly toward the rotational or orbiting boom member 30 against the upward biasing force of the cable drum coil spring 72, the downwardly projecting detent pins 63 are not properly angularly aligned with their respective apertures or recesses 66 defined within the rotational or orbiting boom member 30, the downward biasing force of the solenoid plunger mechanism 78, acting upon the upper surface portion of the upper flanged member 58 of the cable drum assembly 55, will maintain the lower set of detent pins 63 of the cable drum assembly 55 in surface contact or engagement with the upper surface of the rotational or orbiting boom member 30.

It is to be appreciated that at this particular moment or instant in time, since both the upwardly and downwardly projecting detent pins 62, 63 are disengaged from their respective recesses 64, 66 respectively provided within the static boom member 28 and the rotational or orbiting boom member 30, the weight of the stretch film roll carriage assembly 38 will overcome any frictional engagement or drag forces developed between the downwardly projecting detent pins 63 and the upper surface portion of the rotational or orbiting boom member 30, as well as between the upper end portion of the coil spring member 72 and the undersurface portion of the lower flanged member 60 of the cable drum assembly 55, so as to cause the cable drum assembly 55 to undergo a slight predetermined amount of angular rotation with respect to the rotational or orbiting boom member 30. As a result of such rotation of the cable drum assembly 55 rotation with respect to the rotational or orbiting boom member 30, the downwardly projecting detent pins 63 will in effect be angularly aligned with their respective recesses 66 defined within the rotational or orbiting boom member 30 and thereby be able to snap into their respective recesses 66 defined within the rotational or orbiting boom member 30 whereby cable drum assembly 55 will now in effect be rotationally locked upon the rotational or orbiting boom member It is lastly to be noted that, in connection with either one of the modes of operation wherein one of the plunger mechanisms 88, 90 of the solenoid devices 76, 78 engages the upper surface portion of the upper flanged member 58 of the cable drum assembly 55 so as to dispose the cable drum assembly 55 either at its intermediate or lowermost position with respect to the static boom member 28 and the rotational or orbiting boom member 30 as has been noted hereinbefore, despite the fact that the plunger mechanisms 88, 90 of the solenoid devices 76, 78 engage or contact the upper surface portion of the upper flanged member 58 of the cable drum assembly at either one of the diametrically opposite positions eccentric from the rotary axis 34, the elongated bearing assembly 57 of the cable drum assembly 55 prevents any skewing or tilting of the cable drum assembly 55 with respect to the rotary driven shaft 50.

Thus, it may be seen that in accordance with the principles and teachings of the present invention, there has been developed a single motor drive system which is able to operate and control both the rotational or orbital movements of the rotational or orbiting boom member having the stretch film roll carriage assembly mounted thereon so as to achieve stretch film wrapping of a particular palletized load, product, package, or article disposed at a wrapping station of the wrapping or manufacturing facility, as well as the elevational movements of the stretch film roll carriage assembly in accordance with the various operational modes of the stretch film roll carriage assembly attendant different stretch film wrapping techniques to be employed throughout a particular stretch film wrapping operation cycle.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by LETTERS PATENT of the United States of america, is:

1. A single motor drive system, for use in connection with stretch film wrapping apparatus for wrapping stretch film around a load disposed at a wrapping station, comprising:

a static boom member;

a rotational boom assembly rotatably mounted upon said static boom member so as to orbit around the wrapping station of the apparatus at which the load to be wrapped is disposed;

a stretch film roll carriage assembly mounted upon said rotational boom assembly so as to be rotatable around the wrapping station along with said rotational boom assembly, and vertically movable with respect to said rotational boom assembly, such that stretch film dispensed from said stretch film roll carriage assembly is able to be wrapped around the load disposed at the wrapping station at different vertical elevational levels; and a single motor drive arrangement operatively connected to said rotational boom assembly and to said stretch film roll carriage assembly mounted upon said rotational boom assembly for controlling both the rotational movements of said rotational boom assembly around the wrapping station, and the vertical movements of said stretch film roll carriage assembly with respect to said rotational boom assembly such that said stretch film roll carriage assembly can be disposed at said different vertical elevational levels with respect to the load disposed at the wrapping station.

2. The single motor drive system as set forth in claim 1, wherein said single motor drive arrangement comprises:

a motor fixedly mounted upon said static boom member and having a rotary output shaft;

a driven shaft fixedly connected at a first end to said rotational boom assembly and operatively connected at a second end to said rotary output shaft of said motor such that rotation of said rotary output shaft of said motor causes rotation of said rotational boom assembly; and a cable drum assembly, having a first end of a cable fixed thereon and a second end of said cable fixedly connected to said stretch film roll carriage assembly, movably mounted upon said driven shaft between a first position at which said cable drum assembly is fixed upon said static boom member such that, when said rotational boom assembly rotates with respect to said static boom member and said cable drum assembly fixed upon said static boom member, said cable will be wound upon said cable drum assembly so as to elevate said stretch film roll to said different vertical elevational levels such that stretch film dispensed from said stretch film roll carriage assembly will be wrapped around the load at said different vertical elevational levels, and a second position at which said cable drum assembly is freely rotatable upon said driven shaft.

3. The single motor drive system as set forth in claim 2, wherein said single motor drive arrangement further comprises:

a spring member interposed between said rotatable boom assembly and said cable drum assembly for biasing said cable drum assembly to said first position; and a first solenoid device mounted upon said static boom member and engageable with said cable drum assembly, when said first solenoid device is actuated, for moving said cable drum assembly to said second position against the biasing force of said spring member.

4. The single motor drive system as set forth in claim 2, wherein said single motor drive arrangement further comprises:

a plurality of detent recesses provided upon said static boom member; and a plurality of detent pins mounted upon said cable drum assembly for respective disposition within said plurality of detent recesses of said static boom member so as to prevent relative rotation of said cable drum assembly with respect to said static boom member when said cable drum assembly is disposed at said first position.

5. The single motor drive system as set forth in claim 4, wherein:

said plurality of detent recesses and said plurality of detent pins comprises eight detent recesses and eight detent pins equiangularly spaced from each other in an annular array through an angular space of forty-five degrees (45°).

6. The single motor drive system as set forth in claim 1, wherein said single motor drive arrangement comprises:

a motor fixedly mounted upon said static boom member and having a rotary output shaft;

a driven shaft fixedly connected at a first end to said rotational boom assembly and operatively connected at a second end to said rotary output shaft of said motor such that rotation of said rotary output shaft of said motor causes rotation of said rotational boom assembly; and a cable drum assembly, having a first end of a cable fixed thereon and a second end of said cable fixedly connected to said stretch film roll carriage assembly, movably mounted upon said driven shaft between a first position at which said cable drum assembly is fixed upon said static boom member such that, when said rotational boom assembly rotates with respect to said static boom member and said cable drum assembly fixed upon said static boom member, said cable will be wound upon said cable drum assembly so as to elevate said stretch film roll to said different vertical elevational levels such that the stretch film dispensed from said stretch film roll carriage assembly will be wrapped around the load at said different vertical elevational levels, and a second position at which said cable drum assembly is fixed upon said rotational boom assembly such that when said rotational boom assembly rotates around the wrapping station, stretch film dispensed from said stretch film roll carriage assembly will be continuously wrapped around the load disposed at the wrapping station in a reinforcing mode at a particular one of said different elevational levels.

7. The single motor drive system as set forth in claim 6, wherein said single motor drive arrangement further comprises:

a spring member interposed between said rotatable boom assembly and said cable drum assembly for biasing said cable drum assembly to said first position; and a first solenoid device mounted upon said static boom member and engageable with said cable drum assembly, when said first solenoid device is actuated, for moving said cable drum assembly to said second position against the biasing force of said spring member.

8. The single motor drive system as set forth in claim 6, wherein said single motor drive arrangement further comprises:

a plurality of first detent recesses provided upon said static boom member;

a plurality of first detent pins mounted upon said cable drum assembly for respective disposition within said plurality of first detent recesses of said static boom member so as to prevent relative rotation of said cable drum assembly with respect to said static boom member when said cable drum assembly is disposed at said first position;

a plurality of second detent recesses provided upon said rotational boom assembly; and a plurality of second detent pins mounted upon said cable drum assembly for respective disposition within said plurality of second detent recesses of said rotational boom assembly so as to prevent relative rotation of said cable drum assembly with respect to said rotational boom assembly when said cable drum assembly is disposed at said second position.

9. The single motor drive system as set forth in claim 8, wherein:

said plurality of first and second detent recesses and said plurality of first and second detent pins comprises eight detent recesses and eight detent pins equiangularly spaced from each other in an annular array through an angular space of forty-five degrees (45°).

10. The single motor drive system as set forth in claim 1, wherein said single motor drive arrangement comprises:

a motor fixedly mounted upon said static boom member and having a rotary output shaft;

a driven shaft fixedly connected at a first end to said rotational boom assembly and operatively connected at a second end to said rotary output shaft of said motor such that rotation of said rotary output shaft of said motor causes rotation of said rotational boom assembly; and a cable drum assembly, having a first end of a cable fixed thereon and a second end of said cable fixedly connected to said stretch film roll carriage assembly, movably mounted upon said driven shaft between a first position at which said cable drum assembly is fixed upon said static boom member such that, when said rotational boom assembly rotates with respect to said static boom member and said cable drum assembly fixed upon said static boom member, said cable will be wound upon said cable drum assembly so as to elevate said stretch film roll to said different vertical elevational levels such that stretch film dispensed from said stretch film roll assembly will be continuously wrapped around the load at said different vertical elevational levels, a second position at which said cable drum assembly is fixed upon said rotational boom assembly such that when said rotational boom assembly rotates around the wrapping station, stretch film dispensed from said stretch film roll carriage assembly will be continuously wrapped around the load disposed at the wrapping station in a reinforcing mode at a particular one of said different elevational levels, and a third position at which said cable drum assembly is freely rotatable upon said driven shaft so as to permit said stretch film roll carriage assembly to be disposed at a lowermost one of said different elevational levels in preparation for a new stretch film wrapping operation cycle.

11. The single motor drive system as set forth in claim 10, wherein said single motor drive arrangement further comprises:

a spring member interposed between said rotatable boom assembly and said cable drum assembly for biasing said cable drum to said first position;

a first solenoid device mounted upon said static boom member and engageable with said cable drum assembly, when said first solenoid device is actuated, for moving said cable drum assembly to said second position against the biasing force of said spring member; and a second solenoid device mounted upon said static boom member and engageable with said cable drum assembly, when said second solenoid device is actuated and said first solenoid device is deactuated, for moving said cable drum assembly to said third position against the biasing force of said spring member.

12. The single motor drive system as set forth in claim 11, wherein:

said first and second solenoid devices are mounted upon opposite sides of said static boom member.

13. The single motor drive system as set forth in claim 10, wherein said single motor drive arrangement further comprises:

a plurality of first detent recesses provided upon said static boom member;

a plurality of first detent pins mounted upon said cable drum assembly for respective disposition within said plurality of first detent recesses of said static boom member so as to prevent relative rotation of said cable drum assembly with respect to said static boom member when said cable drum assembly is disposed at said first position;

a plurality of second detent recesses provided upon said rotational boom assembly; and a plurality of second detent pins mounted upon said cable drum assembly for respective disposition within said plurality of second detent recesses of said rotational boom assembly so as to prevent relative rotation of said cable drum assembly with respect to said rotational boom assembly when said cable drum assembly is disposed at said second position.

14. The single motor drive system as set forth in claim 13, wherein:

said plurality of first and second detent recesses and said plurality of first and second detent pins comprises eight detent recesses and eight detent pins equiangularly spaced from each other in an annular array through an angular space of forty-five degrees (45°).

15. Stretch film wrapping apparatus for wrapping stretch film around an article, comprising:

a wrapping station at which an article to be wrapped is to be disposed so as to be wrapped within stretch film;

a fixed upright member;

a static boom member connected at a first end thereof to said fixed upright member;

a rotational boom member rotatably mounted at a first end thereof upon a second opposite end of said static boom member so as to orbit around said wrapping station of said apparatus;

a wrapping mast fixedly mounted upon a second opposite end of said rotational boom member;

a stretch film roll carriage assembly mounted upon said wrapping mast so as to be rotatable around said wrapping station along with said rotational boom member, and vertically movable with respect to said rotational boom member, such that stretch film dispensed from said stretch film roll carriage assembly is able to be wrapped around the load disposed at said wrapping station at different vertical elevational levels; and a single motor drive arrangement operatively connected to said rotational boom member and to said stretch film roll carriage assembly mounted upon said wrapping mast for controlling both the rotational movements of said rotational boom member around said wrapping station, and the vertical movements of said stretch film roll carriage assembly with respect to said rotational boom member such that said stretch film roll carriage assembly can be disposed at said different vertical elevational levels with respect to the load disposed at said wrapping station.

16. The stretch film wrapping apparatus as set forth in claim 15, wherein said single motor drive arrangement comprises:

a motor fixedly mounted upon said static boom member and having a rotary output shaft;

a driven shaft fixedly connected at a first end to said rotational boom member and operatively connected at a second end to said rotary output shaft of said motor such that rotation of said rotary output shaft of said motor causes rotation of said rotational boom member; and a cable drum assembly, having a first end of a cable fixed thereon and a second end of said cable fixedly connected to said stretch film roll carriage assembly, movably mounted upon said driven shaft between a first position at which said cable drum assembly is fixed upon said static boom member such that, when said rotational boom member rotates with respect to said static boom member and said cable drum assembly fixed upon said static boom member, said cable will be wound upon said cable drum assembly so as to elevate said stretch film roll to said different vertical elevational levels such that stretch film dispensed from said stretch film roll carriage assembly will be wrapped around the load at said different vertical elevational levels, and a second position at which said cable drum assembly is freely rotatable upon said driven shaft.

17. The stretch film wrapping apparatus as set forth in claim 16, wherein said single motor drive arrangement further comprises:

a spring member interposed between said rotatable boom member and said cable drum assembly for biasing said cable drum assembly to said first position; and a first solenoid device mounted upon said static boom member and engageable with said cable drum assembly, when said first solenoid device is actuated, for moving said cable drum assembly to said second position against the biasing force of said spring member.

18. The stretch film wrapping apparatus as set forth in claim 16, wherein said single motor drive arrangement further comprises:

a plurality of detent recesses provided upon said static boom member; and a plurality of detent pins mounted upon said cable drum assembly for respective disposition within said plurality of detent recesses of said static boom member so as to prevent relative rotation of said cable drum assembly with respect to said static boom member when said cable drum assembly is disposed at said first position.

19. The stretch film wrapping apparatus as set forth in claim 18, wherein:

said plurality of detent recesses and said plurality of detent pins comprises eight detent recesses and eight detent pins equiangularly spaced from each other in an annular array through an angular space of forty-five degrees (45°).

20. The stretch film wrapping apparatus as set forth in claim 15, wherein said single motor drive arrangement comprises:

a motor fixedly mounted upon said static boom member and having a rotary output shaft;

a driven shaft fixedly connected at a first end to said rotational boom member and operatively connected at a second end to said rotary output shaft of said motor such that rotation of said rotary output shaft of said motor causes rotation of said rotational boom member; and a cable drum assembly, having a first end of a cable fixed thereon and a second end of said cable fixedly connected to said stretch film roll carriage assembly, movably mounted upon said driven shaft between a first position at which said cable drum assembly is fixed upon said static boom member such that, when said rotational boom member rotates with respect to said static boom member and said cable drum assembly fixed upon said static boom member, said cable will be wound upon said cable drum assembly so as to elevate said stretch film roll to said different vertical elevational levels such that the stretch film dispensed from said stretch film roll carriage assembly will be wrapped around the load at said different vertical elevational levels, and a second position at which said cable drum assembly is fixed upon said rotational boom member such that when said rotational boom assembly rotates around said wrapping station, stretch film dispensed from said stretch film roll carriage assembly will be continuously wrapped around the load disposed at said wrapping station in a reinforcing mode at a particular one of said different elevational levels.

21. The stretch film wrapping apparatus as set forth in claim 20, wherein said single motor drive arrangement further comprises:

a spring member interposed between said rotatable boom member and said cable drum assembly for biasing said cable drum assembly to said first position; and a first solenoid device mounted upon said static boom member and engageable with said cable drum assembly, when said first solenoid device is actuated, for moving said cable drum assembly to said second position against the biasing force of said spring member.

22. The stretch film wrapping apparatus as set forth in claim 20, wherein said single motor drive arrangement further comprises:

a plurality of first detent recesses provided upon said static boom member;

a plurality of first detent pins mounted upon said cable drum assembly for respective disposition within said plurality of first detent recesses of said static boom member so as to prevent relative rotation of said cable drum assembly with respect to said static boom member when said cable drum assembly is disposed at said first position;

a plurality of second detent recesses provided upon said rotational boom member; and a plurality of second detent pins mounted upon said cable drum assembly for respective disposition within said plurality of second detent recesses of said rotational boom member so as to prevent relative rotation of said cable drum assembly with respect to said rotational boom member when said cable drum assembly is disposed at said second position.

23. The stretch film wrapping apparatus as set forth in claim 22, wherein:

said plurality of first and second detent recesses and said plurality of first and second detent pins comprises eight detent recesses and eight detent pins equiangularly spaced from each other in an annular array through an angular space of forty-five degrees (45°).

24. The stretch film wrapping apparatus as set forth in claim 15, wherein said single motor drive arrangement comprises:

a motor fixedly mounted upon said static boom member and having a rotary output shaft;

a driven shaft fixedly connected at a first end to said rotational boom member and operatively connected at a second end to said rotary output shaft of said motor such that rotation of said rotary output shaft of said motor causes rotation of said rotational boom member; and a cable drum assembly, having a first end of a cable fixed thereon and a second end of said cable fixedly connected to said stretch film roll carriage assembly, movably mounted upon said driven shaft between a first position at which said cable drum assembly is fixed upon said static boom member such that, when said rotational boom member rotates with respect to said static boom member and said cable drum assembly fixed upon said static boom member, said cable will be wound upon said cable drum assembly so as to elevate said stretch film roll to said different vertical elevational levels such that stretch film dispensed from said stretch film roll assembly will be continuously wrapped around the load at said different vertical elevational levels, a second position at which said cable drum assembly is fixed upon said rotational boom member such that when said rotational boom member rotates around said wrapping station, stretch film dispensed from said stretch film roll carriage assembly will be continuously wrapped around the load disposed at said wrapping station in a reinforcing mode at a particular one of said different elevational levels, and a third position at which said cable drum assembly is freely rotatable upon said driven shaft so as to permit said stretch film roll carriage assembly to be disposed at a lowermost one of said different elevational levels in preparation for a new stretch film wrapping operation cycle.

25. The stretch film wrapping apparatus as set forth in claim 24, wherein said single motor drive arrangement further comprises:

a spring member interposed between said rotatable boom member and said cable drum assembly for biasing said cable drum to said first position;

a first solenoid device mounted upon said static boom member and engageable with said cable drum assembly, when said first solenoid device is actuated, for moving said cable drum assembly to said second position against the biasing force of said spring member; and a second solenoid device mounted upon said static boom member and engageable with said cable drum assembly, when said second solenoid device is actuated and said first solenoid device is deactuated, for moving said cable drum assembly to said third position against the biasing force of said spring member.

26. The stretch film wrapping apparatus as set forth in claim 25, wherein:

said first and second solenoid devices are mounted upon opposite sides of said static boom member.

27. The stretch film wrapping apparatus as set forth in claim 24, wherein said single motor drive arrangement further comprises:

a plurality of first detent recesses provided upon said static boom member;

a plurality of first detent pins mounted upon said cable drum assembly for respective disposition within said plurality of first detent recesses of said static boom member so as to prevent relative rotation of said cable drum assembly with respect to said static boom member when said cable drum assembly is disposed at said first position;

a plurality of second detent recesses provided upon said rotational boom member; and a plurality of second detent pins mounted upon said cable drum assembly for respective disposition within said plurality of second detent recesses of said rotational boom member so as to prevent relative rotation of said cable drum assembly with respect to said rotational boom member when said cable drum assembly is disposed at said second position.

28. The stretch film wrapping apparatus as set forth in claim 27, wherein:

said plurality of first and second detent recesses and said plurality of first and second detent pins comprises eight detent recesses and eight detent pins equiangularly spaced from each other in an annular array through an angular space of forty-five degrees (45°).

* * * * *